US005918339A

United States Patent [19]

Marioni et al.

[11] Patent Number: 5,918,339

[45] Date of Patent: Jul. 6, 1999

[54] ANTISEISMIC ENERGY DISSIPATOR FOR STRUCTURES SUCH AS VIADUCTS AND THE LIKE

[75] Inventors: Agostino Marioni, Milan; Andrea Silvestri, Pavia; Mario Ubaldini, Milan, all of Italy

[73] Assignee: A. L. G. A. Applicazione Lavorazione Giunti Appoggi S.P.A., Milan, Italy

[21] Appl. No.: 08/879,741

[22] Filed: Jun. 20, 1997

[30] Foreign Application Priority Data

Aug. 6, 1996 [IT] Italy ..... MI96A1713

[51] Int. Cl.[6] ..... E01D 19/04

[52] U.S. Cl. ..... 14/73.5; 52/167.1

[58] Field of Search ..... 14/73.5; 52/167.1, 52/167.2; 310/80, 90.5, 103, 105, 110; 248/550, 562, 638, 637; 267/140.11; 188/158, 161, 162

[56] References Cited

U.S. PATENT DOCUMENTS

| | | | |
|---|---|---|---|
| 4,605,106 | 8/1986 | Fyfe et al. | 14/73.5 X |
| 4,883,250 | 11/1989 | Yano et al. | 248/638 |
| 5,321,923 | 6/1994 | Oda | 52/167.1 |
| 5,391,953 | 2/1995 | Van De Veen | 310/80 |
| 5,553,342 | 9/1996 | Townsend | 14/73.5 X |
| 5,713,162 | 2/1998 | Gallo et al. | 52/167.1 |

FOREIGN PATENT DOCUMENTS

| | | |
|---|---|---|
| 0477144 | 3/1992 | European Pat. Off. . |
| 2544432 | 11/1982 | France . |
| 3522221 | 2/1986 | Germany . |
| 0079048 | 5/1983 | Japan . |
| 58-174740 | 10/1983 | Japan . |
| 01214646 | 8/1989 | Japan . |
| 07091104 | 4/1995 | Japan . |

*Primary Examiner*—Tamara Graysay
*Assistant Examiner*—Sunil Singh
*Attorney, Agent, or Firm*—Townsend and Townsend and Crew

[57] ABSTRACT

An energy dissipator for interposition between parts of a structure, for example, between a support structure and a deck of a viaduct, protecting the structure in the event of an earthquake in an effective and consistent manner which conforms to expectations even a very long time after installation and also in the event of repeated operation, comprises an electrical generator interposed between the parts and operated by relative movement between the parts as a result of the earthquake.

3 Claims, 2 Drawing Sheets

ANTISEISMIC ENERGY DISSIPATOR FOR STRUCTURES SUCH AS VIADUCTS AND THE LIKE

FIELD OF THE INVENTION

The present invention relates to an energy dissipator for interposition between parts of a structure, for example, between a support structure and a deck of a viaduct, to protect the structure in the event of relative movement between the parts as a result of an earthquake.

As is known, structures such as, for example, viaducts, have to be protected against damage which could be caused to them by earthquakes.

BACKGROUND OF THE INVENTION

To satisfy this requirement, energy dissipators in which movement between the parts of the structure as a result of an earthquake is resisted by steel elements which undergo considerable deformation when their yield stress is exceeded are known and used extensively.

Owing to the magnitude of the deformations undergone, the behaviour of these elements leaves the elastic range and enters the plastic range, giving rise to energy dissipation.

Once installed, these energy dissipators have the disadvantage, in use, of behaviour which is often far-removed from the expected behaviour. Moreover, their behaviour is not repeated identically with repeated earthquakes but deteriorates gradually until it is wholly inadequate.

Energy dissipators substantially of the hydraulic shock-absorber type have been proposed. These dissipators cannot be left installed for years and years with confidence that they will function as they should when required. On the contrary, they require onerous periodic maintenance operations to replace seals and to top up the oil or to replace them with new improved dissipators, with all of the problems which accompany such operations.

The problem upon which the present invention is based is that of devising an energy dissipator of the type specified which has structural and functional characteristics such as to overcome the disadvantages mentioned above with reference to the dissipators of the prior art.

SUMMARY OF THE INVENTION

This problem is solved by a dissipator of the type specified which is characterized in that it comprises an electrical generator operated by the said movement.

BRIEF DESCRIPTION OF THE DRAWINGS

Further characteristics and the advantages of the dissipator according to the present invention will become clear from the following description of a preferred embodiment thereof, given by way of non-limiting example with reference to the appended drawings, in which.

DETAILED DESCRIPTION OF THE INVENTION

Figure 1:
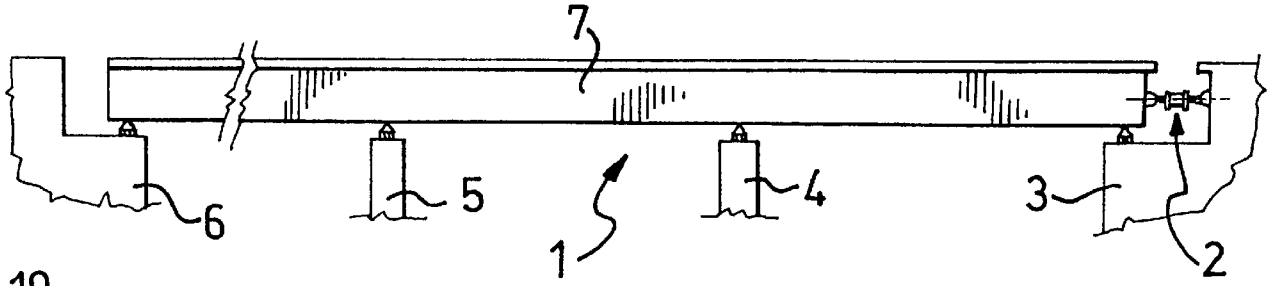
FIG. 1 shows a structure incorporating an energy dissipator according to the present invention.

With reference to the appended drawings, a structure, generally indicated 1, incorporates an energy dissipator 2 according to the invention.

The structure 1 is a viaduct comprising support structures such as a supporting abutment 3, piers 4 and 5, and an opposed supporting abutment 6. A longitudinal deck 7 bears on the support structures 3, 4, 5 and 6.

The dissipator 2, which comprises an electrical generator 8, is interposed between the supporting abutment 3 and the deck 7.

The electrical generator 8 which, in practice, is a dynamo, comprises a stator 9 and a rotor 10 in relative rotary motion.

The stator 9 has a longitudinal axis X—X. The rotor 10, which has an outside diameter D, is supported for rotation in the stator 9, coaxially therewith, by means of bearings 11 and 12 which can withstand radial forces and axial thrusts.

The stator 9 carries permanent magnets 13, whereas the rotor carries elements 14 of ferromagnetic material, preferably windings of conductive material with predetermined resistance.

The stator 9 comprises a tubular shell 15 and opposed heads 16 and 17 facing towards the supporting abutment 3 and towards the deck 7, respectively, and is fixed, by the head 16, to the supporting abutment 3, by means of a conventional articulated joint 18 which permits slight inclination of the stator but prevents rotation of the stator about its axis.

The rotor 10 is connected to the deck 7 by means of a mechanical transmission 19 which comprises a male-and-female screw coupling 20 of axis X—X. The coupling 20 is reversible, having an efficiency greater than 0.5, for example, an efficiency of 0.8.

In particular, the coupling 20 comprises a female-threaded member 21 which is fixed to the rotor 10 and a screw 22 of pitch P, extending through the head 17 and having one end 23 fixed to the deck 7 by means of an articulated joint 24 substantially identical to the articulated joint 18.

A protective bellows 25 extends between the end 23 of the screw and the head 17.

In the event of an earthquake, a horizontal movement taking place between the supporting abutment 3 and the deck 7 at a given relative velocity brings about an equal axial movement of the screw relative to the stator and to the rotor and consequently a corresponding rotation of the rotor relative to the stator at a corresponding peripheral velocity. This velocity can be made greater than the aforementioned relative velocity by the selection of a large value for the diameter D of the rotor and a small value for the pitch P.

Energy dissipation takes place in the electrical generator since the currents induced in the rotor by the magnetic field created by the stator generate heat which is dispersed into the atmosphere. Added to this energy dissipation is the energy dissipation which takes place owing to friction in the male-and-female screw coupling, in a proportion representing the complement of its efficiency to unity, that is, 0.2 in this embodiment.

The dimensions of the electrical generator can thus easily be such that it takes care of its portion of the total energy dissipation required, that is, 0.8 in the embodiment described.

Figure 2:
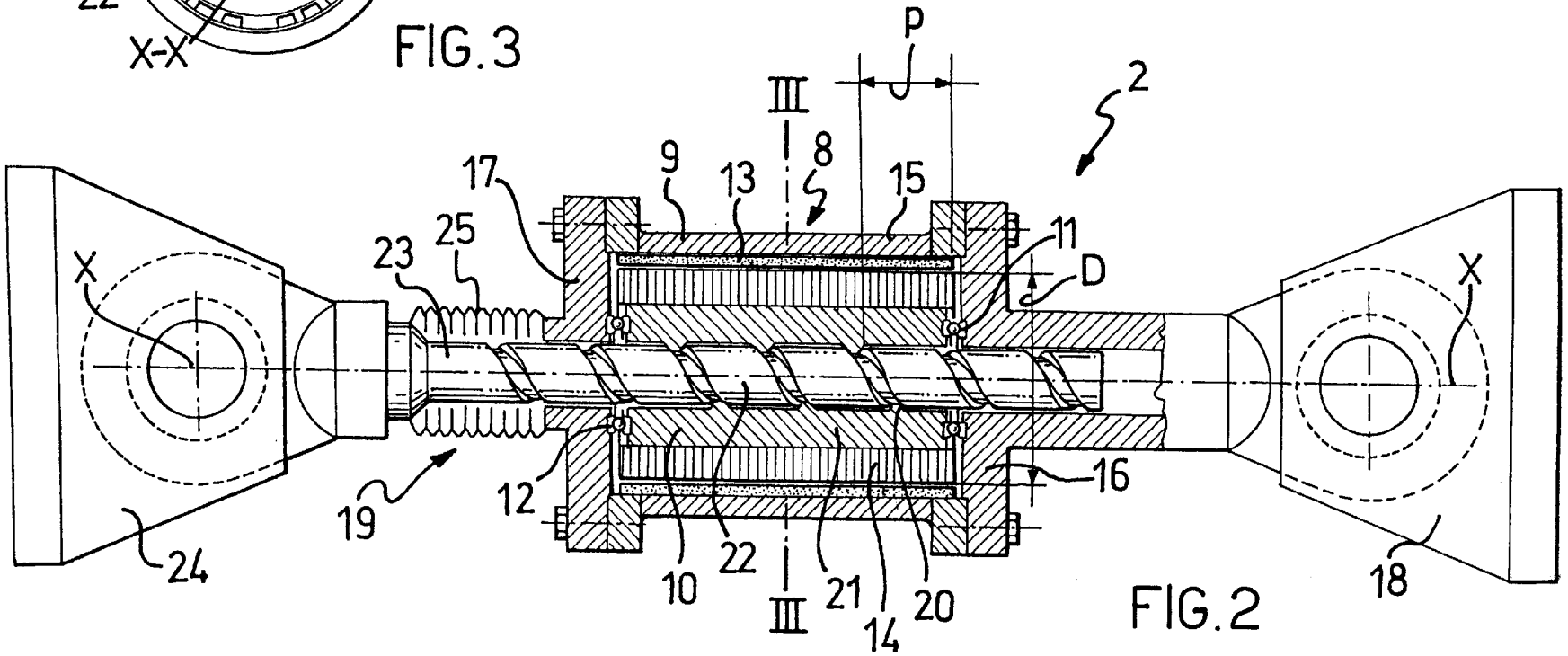
FIG. 2 shows the dissipator of FIG. 1, on an enlarged scale and in section.
Figure 3:
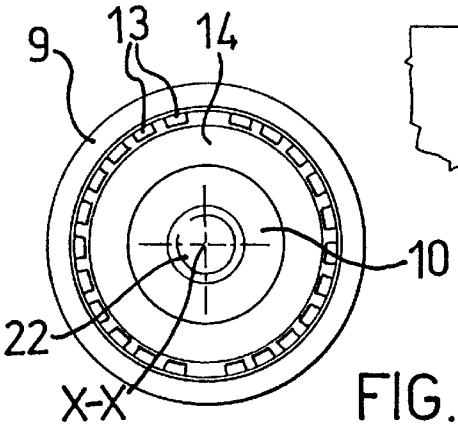
FIG. 3 shows the dissipator of FIG. 2, sectioned on the line III—III.
Figure 4:
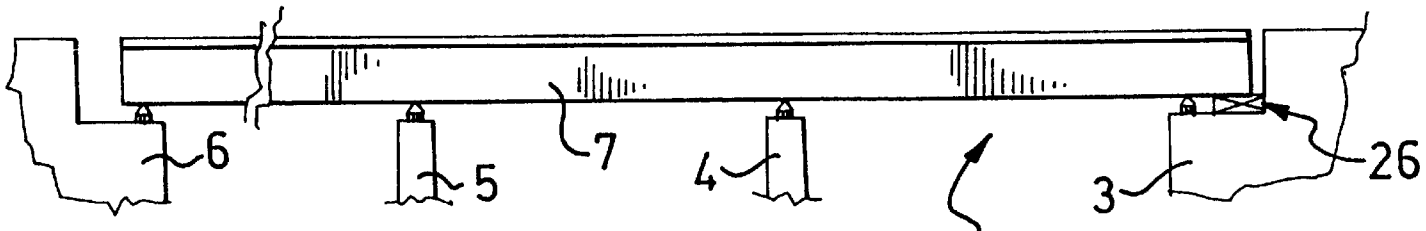
FIG. 4 is an elevational view of a structure incorporating an energy dissipator according to a variant of the invention.
Figure 5:
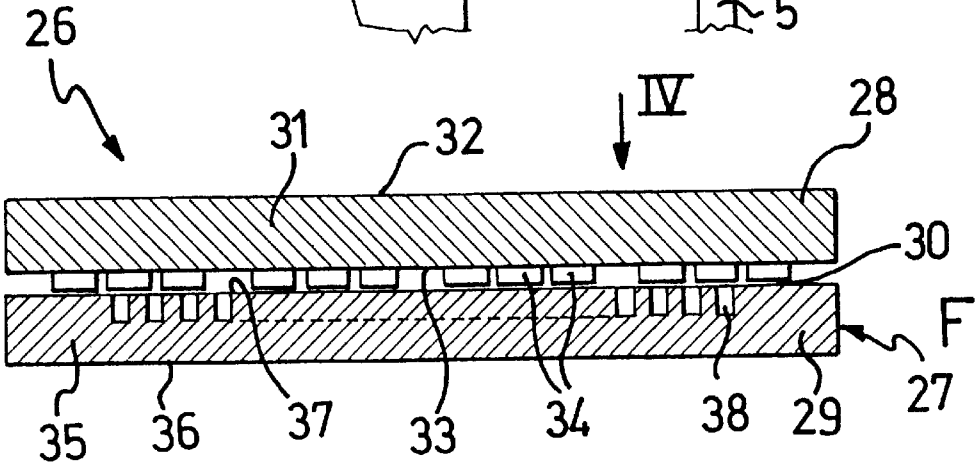
FIG. 5 shows the dissipator of FIG. 4, on an enlarged scale and in section.
Figure 6:
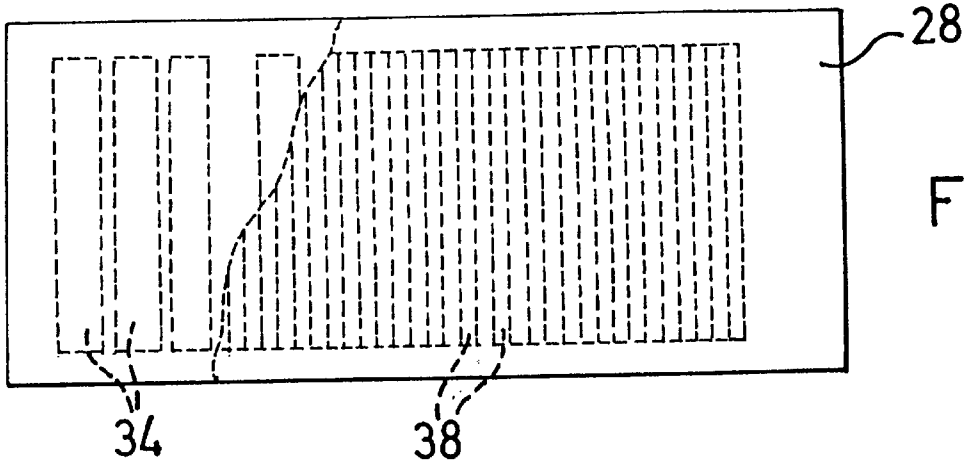
FIG. 6 is a partially transparent plan view of the dissipator of FIG. 5, taken on the arrow VI.

Reference will now be made to FIGS. 4, 5 and 6, in which elements remaining the same as in FIGS. 1, 2 and 3 bear the same reference numerals.

The viaduct 1 incorporates an energy dissipator 26 which is interposed between the supporting abutment 3 and the deck 7.

The dissipator 26 comprises an electrical generator 27 which, in practice, is a dynamo extending in a plane.

In particular, the electrical generator 27 comprises an inductor 28 and an armature 29 both in the form of plates arranged horizontally, defining an air gap 30, and translatable relative to one another.

The plate-like inductor 28 comprises a plate-like body 31 with a flat upper surface 32 by which the inductor is fixed to the deck 7 and a flat lower surface 33 which carries permanent magnets 34.

The plate-like armature 29 comprises a plate-like body 35 having a flat lower surface 36 by which the armature is fixed to the supporting abutment 3 in a manner such that the air gap 30 has a predetermined value, for example, from 1 to 4 mm, and a flat upper surface 37 which carries elements 38 of ferromagnetic material, preferably conductors with predetermined resistance.

In the event of an earthquake, a horizontal movement taking place between the supporting abutment 3 and the deck 7 at a given relative velocity brings about an equal relative translational movement of the inductor and the armature. In this embodiment, energy dissipation also takes place since the currents induced in the armature by the magnetic field created by the inductor generate heat which is dispersed into the atmosphere. Since, in practice, there is no energy dissipation by friction, the whole of the required energy dissipation takes place in the electrical generator which can easily have dimensions suitable for this purpose.

The main advantage of the dissipator according to the invention lies in its reliability. In fact, it remains installed, ready to operate, for a practically unlimited period without requiring maintenance.

Its performance is very consistent even when it is installed in different climatic conditions.

A further advantage of the dissipator according to the present invention lies in the fact that there is little difference between its actual behaviour and the theoretical behaviour expected upon the selection of its dimensions.

A further advantage of the dissipator according to the present invention lies in the fact that its behaviour is also consistent in the event of repeated operation.

Finally, it should be noted that the dissipator according to the present invention can be structurally simple and strong, which is no small advantage for an item which is to be incorporated in large structures on large construction sites.

We claim:

1. An energy dissipator for interposition between parts of a structure to protect the structure in the event of relative movement between the parts as a result of an earthquake, wherein the dissipator comprises an electrical generator operated by said movement, and wherein the electrical generator comprises an inductor and an armature both in the form of plates, disposed side by side, defining an air gap, and translatable relative to one another, each being fixed to a respective part of the structure.

2. An energy dissipator for interposition between parts of a structure to protect the structure in the event of relative movement between the parts as a result of an earthquake, wherein the dissipator comprises an electrical generator operated by said movement, wherein the electrical generator comprises an inductor and an armature both in the form of plates, disposed side by side, defining an air gap, and translatable relative to one another, each being fixed to a respective part of the structure, and wherein the inductor comprises a plate-like body and a plurality of permanent magnets fixed to the plate-like body.

3. An energy dissipator for interposition between parts of a structure to protect the structure in the event of relative movement between the parts as a result of an earthquake, wherein the dissipator comprises an electrical generator operated by said movement, wherein the electrical generator comprises an inductor and an armature both in the form of plates, disposed side by side, defining an air gap, and translatable relative to one another, each being fixed to a respective part of the structure, and wherein the armature comprises a plate-like body and elements made of a ferromagnetic material and fixed to the plate-like body.

* * * * *